US007347303B2

(12) United States Patent
Kontturi et al.

(10) Patent No.: US 7,347,303 B2
(45) Date of Patent: Mar. 25, 2008

(54) METHOD AND APPARATUS FOR GENERATING ELEVATOR CALLS

(75) Inventors: Risto Kontturi, Rajamäki (FI); Jari Ylinen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/603,175

(22) Filed: Nov. 22, 2006

(65) Prior Publication Data

US 2007/0131487 A1 Jun. 14, 2007

Related U.S. Application Data

(63) Continuation of application No. PCT/FI2005/000228, filed on May 18, 2005.

(30) Foreign Application Priority Data

Jun. 28, 2004 (FI) ..... 20040890

(51) Int. Cl.
*B66B 1/16* (2006.01)

(52) U.S. Cl. ..... 187/380; 187/384; 187/388; 187/391

(58) Field of Classification Search ..... 187/247, 187/248, 380, 382, 384, 386–389, 391, 392, 187/393, 396; 455/420, 422.1, 435.1
See application file for complete search history.

(56) References Cited

U.S. PATENT DOCUMENTS

| | | | | |
|---|---|---|---|---|
| 6,109,396 | A * | 8/2000 | Sirag et al. | 187/381 |
| 6,202,799 | B1 * | 3/2001 | Drop | 187/388 |
| 6,397,976 | B1 | 6/2002 | Hale et al. | |
| 6,615,175 | B1 | 9/2003 | Gazdzinski | |
| 6,868,945 | B2 * | 3/2005 | Schuster et al. | 187/380 |
| 6,986,408 | B2 * | 1/2006 | Takeuchi | 187/380 |
| 2003/0159890 | A1 | 8/2003 | Schuster et al. | |

FOREIGN PATENT DOCUMENTS

EP 1 043 260 A1 10/2000

OTHER PUBLICATIONS http://www.bluetooth.com/Bluetooth/learn/security/ pp. 1-5.*

* cited by examiner

*Primary Examiner*—Jonathan Salata
(74) *Attorney, Agent, or Firm*—Birch, Stewart, Kolasch & Birch, LLP

(57) ABSTRACT

A method and a system for generating a request for elevator service in which the elevator user receives with his/her terminal a general transmission of information about the elevator system from base stations placed in the elevator lobby of the building. By way of the terminal, a service request is generated on the basis of the goal and the information provided by the general transmission. The service request is transmitted further to an elevator group controller via an edge server and a local server. The edge server checks the request for correctness, and the local server functions as a point of connection between the elevator group and the external world.

12 Claims, 3 Drawing Sheets

METHOD AND APPARATUS FOR GENERATING ELEVATOR CALLS

Figure 1:
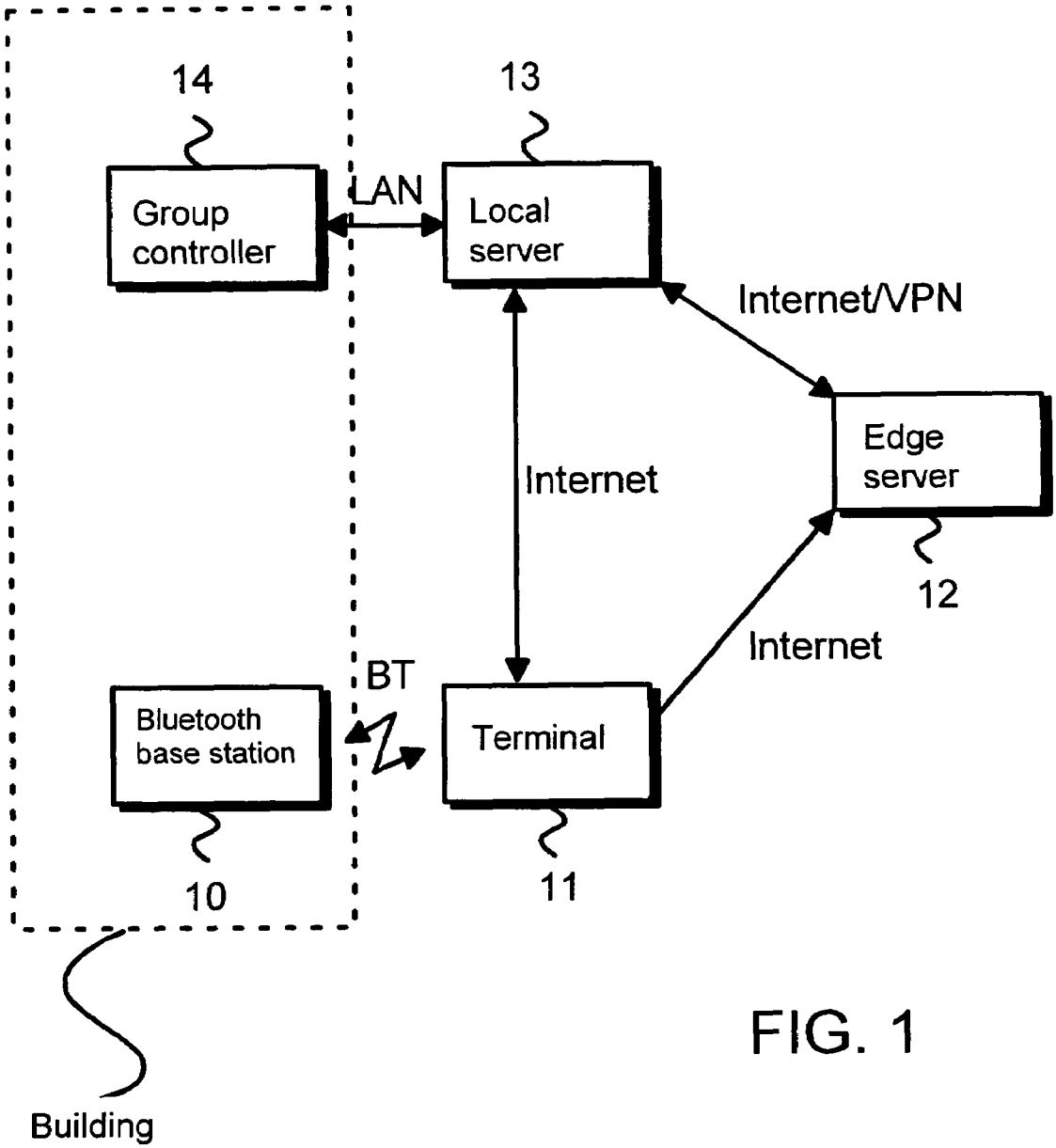

This application is a Continuation of copending PCT International Application No. PCT/FI2005/000228 filed on May 18, 2005, which designated the United States, and on which priority is claimed under 35 U.S.C. § 120. This application also claims priority under 35 U.S.C. § 119(a) on Patent Application No(s). 20040890 filed in Finland on Jun. 28, 2004. The entire contents of each of the above documents is hereby incorporated by reference.

FIELD OF THE INVENTION

The present invention relates to routing of information and data between an elevator system and elevator users.

BACKGROUND OF THE INVENTION

Traditionally, in elevator systems an elevator is called by pressing a call button placed beside the elevator, whereupon an elevator car is moved to the desired floor in accordance with certain rules. There are typically two call buttons, by means of which the traveling direction of the elevator is defined. In this procedure, the customer waits for an elevator, after which the floor is selected from the elevator car. During the journey, the elevator car may stop several times to let passengers leave the car. This is problematic especially in large buildings having several elevators and even several elevator lobbies. Large buildings are often also provided with express elevators on which passengers can only reach certain floors. In these cases the traditional procedure of calling an elevator is often slow and troublesome, especially when the user is unfamiliar with the building and does not know the elevator system beforehand.

Modern portable terminals, e.g. mobile telephones, allow the provision of many different services. U.S. patent application Ser. No. 2002/0129170 describes a kiosk service using a personal area network. The network, e.g. a Bluetooth link, is provided in a public space allowing utilization of the kiosk service, from which it is possible to order electric services.

International patent application WO 01/20844 describes an electronic data transmission service. In the service, the customer uses his/her terminal to order a product, which can be picked up from a vending machine. The vending machine gets information from a server over mobile telephone link and communicates with the terminal via a Bluetooth connection.

International patent application WO 02/076024 describes a base station for the arrangement of an information service. The base station according to this application has a data bank for storing information concerning the services associated with the information service.

Prior-art systems are not suited for calling elevators in an environment where there are several elevators of which not all stop at every floor. Therefore, there is a need for a system that will eliminate or at least alleviate the above-mentioned problems.

OBJECT OF THE INVENTION

The object of the invention is to provide a method and a system for routing information and data between an elevator system and the users of the elevators. A specific object of the invention is to disclose a new type of system for making a call for an elevator.

BRIEF DESCRIPTION OF THE INVENTION

The inventive content disclosed in the application can be defined in various ways and may also comprise several separate inventions, especially if the invention is considered in the light of explicit or implicit sub-tasks or in respect of advantages or sets of advantages achieved. Within the framework of the basic concept of the invention, features of different embodiments of the invention can be applied in conjunction with other embodiments.

The object of the invention is to provide a method and a system for generating requests for elevator service. In the system of the invention, when a person arrives in an elevator arrival lobby in the building, his/her wireless terminal, e.g. a mobile telephone, receives a general transmission. The general transmission contains information about the elevator system. On the basis of the information received and the destination, the terminal generates a service request to the elevator. The general transmission is preferably implemented using short-range wireless network technology.

The service request generated is transmitted to an edge server, which checks the request for correctness. If the request is correct and of allowed form, then the edge server will transmit the data to a local server. The local server functions as a gateway between the elevator system and the external world. In this way, only feasible requests are transmitted to the elevator system. After the request has been carried out, the system transmits status information to the person and guides him/her to the right elevator.

The invention makes it considerably easier for a person to move about especially in large buildings with complex elevator systems. The user of the system need not know the building beforehand, but the system can guide the user to the right elevator by the information transmitted to the terminal as well as order a ride directly to the right floor. The system is useful in cases where the user utilizes the same elevator often, e.g. when arriving at his/her work place. In this case, the person can walk directly to a desired elevator, which can take him/her directly to the destination, without the user calling for an elevator or selecting the floor.

LIST OF FIGURES

Figure 2:
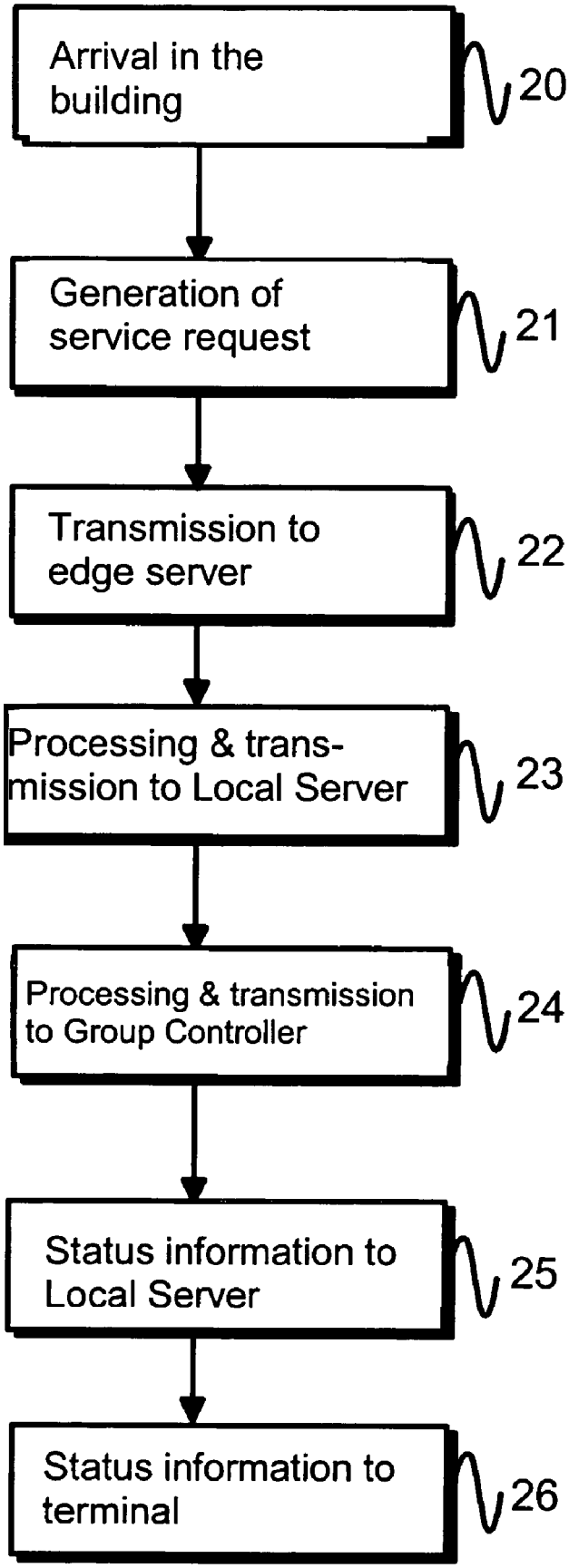
Figure 3:
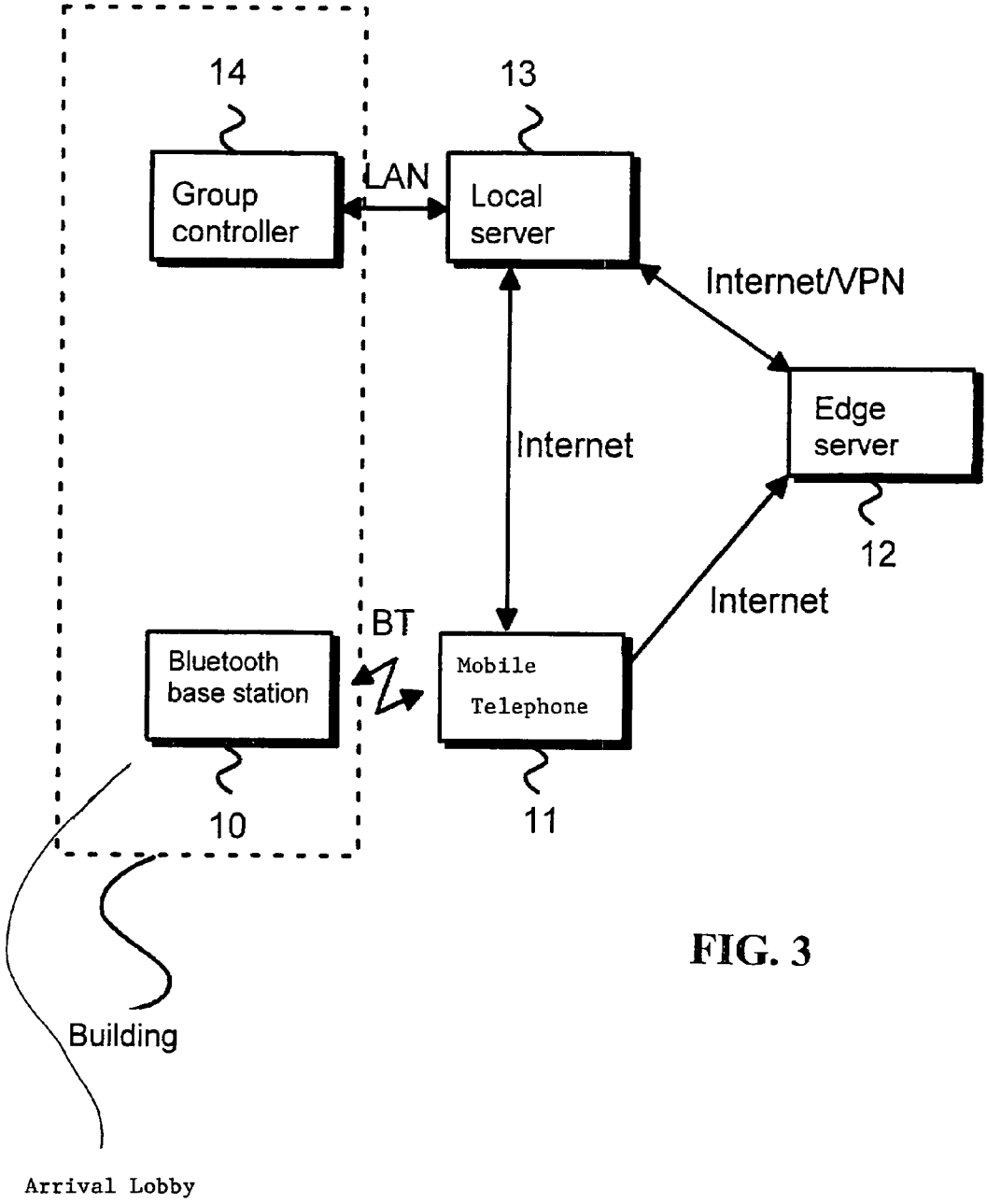

FIG. 1 presents an example of a system according to an embodiment of the invention;

FIG. 2 illustrates the method of an embodiment of the invention in the example system presented in FIG. 1; and FIG. 3 illustrates a further example of a system according to an embodiment of the invention.

DETAILED DESCRIPTION OF THE INVENTION

The present invention relates to routing of information and data between an elevator system and elevator users. FIG. 1 presents an example of implementing the system of the invention. The system in FIG. 1 comprises a Bluetooth base station 10, a terminal 11, an edge server 12, a local server 13 and a group controller 14. Instead of a Bluetooth base station 10, it is possible to use any short-range communication solution. Bluetooth has been selected as an example only because of its wide usage. As can be seen from FIG. 1, the Bluetooth base station 10 and the group controller 14 are building-specific components.

In an application according to the invention, the Bluetooth base station 10 transmits information in a general transmission. The data flow of the general transmission may comprise e.g. a building identifier, a floor identifier, safety information, a base station identifier, an alternative Internet address, check sums or other corresponding data.

The terminal 11 is provided with client software, which can be implemented by any technique used in the mobile telephone, e.g. Java or using the client software of the specific operating system of the telephone. Via the software it is possible to generate both general and specific service requests.

The service requests are transmitted to the edge server 12. The transmission can be implemented e.g. by utilizing a telephone Internet connection or by some other alternative technique. At this stage, the mobile telephone is used to transmit the information received from the Bluetooth base station 10 and the information comprised in the service request, including e.g. destination floor of the service request, version of the client software, type of the mobile telephone and other corresponding data. The mobile telephone type data can be utilized e.g. in displaying status information on the customer's screen, in which case it is essential to know the screen size in order to improve usability. If necessary, the service request can be encrypted. The information can also be checked for correctness in the edge server 12.

The edge server 12 transmits the checked service request to the local server 13. The edge server 12 and the local server 13 can be implemented in the same server unit, so it is unnecessary to have separate severs. The local server 13 functions as a point of connection between the elevator system and the external world. This ensures that unauthorized access to the control of the elevator system is not possible, but all communication between the elevator group control system 14 and the external world takes place via the local server 13. The local server 13 can establish a direct connection to the customer's terminal 11 to transmit status information regarding the service request.

FIG. 2 illustrates the method of the invention in the example system presented in FIG. 1. The procedure according to this method is started when the customer arrives in the building, step 20. The customer's terminal detects the general transmission by the Bluetooth base stations in the building and activates the client software.

After the detection of the system, a service request is generated, step 21. The service request consists of the information sent by the Bluetooth system and the selections made by the customer. After this, the customer can select the destination floor, or in a familiar environment it can be programmed beforehand and the client software transmits it automatically. Automatic transmission is particularly expedient if the customer is going to the target for the first time. In this case, the information can be obtained e.g. from the target's calling card or www pages.

The service request generated is transmitted further to the edge server, step 22. If desirable, the transmission can be encrypted. The edge server processes the message and transmits it further to the local server, step 23. In the processing by the edge server, the service request is decrypted if appropriate and checked for correctness. Correctness in this situation typically refers to the structural form of the message instead of its contents.

The local server processes the message further and transmits it to the group controller, step 24. The local server has more specific information about the group controller, so the processing may consist in e.g. converting the service request into a form understood by the group controller. The further processing may relate to status information about the elevator system that does not require immediate information about the state of the elevator system.

The group controller processes the service request and transmits the status information to the local server, step 25. The group controller processes the service request by comparing it to the state of the elevator system and returns as status information e.g. the elevator number that the customer should use. This is especially useful in large buildings provided with express elevators transporting customers to elevator lobbies located e.g. at 10-floor distances between them, from where the rest of the way can be traveled on an ordinary elevator. Thus, the customer need not know which elevator will take him/her to the destination, but the system tells this to the customer.

The local server transmits the status information generated by the group controller further to the customer's terminal, step 26. The customer can see on the screen of his/her terminal device the elevator number that will serve him/her.

It is obvious to the person skilled in the art that the invention is not limited to the embodiments described above, in which the invention has been described by way of example, but that different embodiments of the invention are possible within the scope of the inventive concept defined in the claims presented below.

The invention claimed is:

1. A system for generating a request for elevator service, characterized in that the system comprises:

a base station (10) for transmitting a general transmission;

a terminal (11) for receiving the general transmission and generating a service request;

an edge server (12) for receiving and checking the service request from the terminal (11);

a local server (13) for connection of communication between the elevator group and the external world; and a group controller (14) for controlling the elevator group and generating, status information to be sent to the terminal (11) via the local server (13).

2. A system according to claim 1, characterized in that the terminal has been arranged to select the goal and generate the service request automatically on the basis of predefined information.

3. A system according to claim 1 or 2, characterized in that the terminal has been arranged transmit the service request over a short-range communication network.

4. A system according to claim 1 or 2, characterized in that the terminal has been arranged to transmit the service request by using a data transfer connection in a mobile telephone network.

5. A system according to claim 1, characterized in that the communication between the components of the system is encrypted.

6. A method for generating a request for elevator service comprising the steps of:

storing a destination in a terminal device;

receiving a general transmission from a base station in an arrival lobby;

in response to receipt of the general transmission, automatically transmitting to a server a service request based on the destination stored in the terminal device;

transmitting the service request from the server to an elevator group control system; and transmitting to the terminal elevator car identifying information responsive to the service request.

7. A method according to claim 6 wherein said step of transmitting the service request comprises the step of transmitting the service request over a short-range communication network.

8. A method according to claim 6 wherein said step of transmitting the service request comprises the step of transmitting the service request with a data transfer connection in a mobile telephone network.

9. The method of claim 6 including the additional step of encrypting the service request.

10. The system of claim 6 wherein said terminal includes stored destination information and automatically generates the service request based on the stored destination information in response to receipt of the general transmission.

11. The system of claim 1 wherein said terminal includes stored destination information before receipt of the general transmission and automatically generates the service request based on the stored destination information in response to receipt of the general transmission.

12. A system for generating a request for elevator service comprising:

a base station for transmitting a general transmission;

a terminal for receiving the general transmission, storing destination information and, in response to the general transmission, automatically generating a service request based on the stored destination information;

an edge server for receiving and checking the service request from the terminal;

a local server for connection of communication between the elevator group and the external world; and a group controller for controlling the elevator group and generating status information to be sent to the terminal via the local server.

* * * * *